United States Patent [19]

Burgoon et al.

[11] 4,219,901

[45] Sep. 2, 1980

[54] RIDING SWEEPER

[75] Inventors: Jack L. Burgoon; Christopher M. Knowlton, both of Toledo, Ohio

[73] Assignee: The Scott & Fetzer Company, Lakewood, Ohio

[21] Appl. No.: 974,367

[22] Filed: Dec. 29, 1978

Related U.S. Application Data

[62] Division of Ser. No. 852,199, Nov. 17, 1977, Pat. No. 4,173,052.

[51] Int. Cl.[3] ..... A47L 11/202

[52] U.S. Cl. ..... 15/352; 55/429; 55/493

[58] Field of Search ..... 15/78, 82, 83–87, 15/340, 347, 349, 352; 55/429, 422, 432, 430, 493; 298/10, 24 R

[56] References Cited

U.S. PATENT DOCUMENTS

| | | | |
|---|---|---|---|
| 2,614,279 | 10/1952 | Mott | 15/83 |
| 2,784,440 | 3/1957 | Newport | 15/352 X |
| 3,006,021 | 10/1961 | Patch | 15/83 X |
| 3,304,572 | 2/1967 | Wendel | 15/352 X |
| 3,490,090 | 1/1970 | Harrison | 15/87 X |
| 3,504,482 | 4/1970 | Goettl | 55/493 X |
| 3,570,220 | 3/1971 | Felter | 55/493 X |
| 3,837,157 | 9/1974 | van der Lely | 15/87 X |

FOREIGN PATENT DOCUMENTS

| | | | |
|---|---|---|---|
| 2309813 | 9/1973 | Fed. Rep. of Germany | 15/83 |

*Primary Examiner*—Christopher K. Moore
*Attorney, Agent, or Firm*—Allen D. Gutchess, Jr.

[57] ABSTRACT

A riding power sweeper with an improved dumping mechanism for emptying a hopper is provided. The hopper is pivotally supported at the front of the machine and a pair of fluid-operated rams raise the hopper and pivot it over the front. The hopper also has a unique air distribution system including a filter through which air is drawn from an opening communicating with a drum brush. Means forming a separate chamber is located in the hopper and holds the filter, and dirt from the filter is caught therein. The chamber-forming means is also pivotally supported so as to swing outwardly to be emptied when the hopper is raised. The drum brush has a unique design for adjusting and positioning the brush with a single linkage mechanism both applying pressure and adjusting the brush for wear.

7 Claims, 8 Drawing Figures

RIDING SWEEPER

This is a division of application Ser. No. 852,199 filed Nov. 17, 1977, now U.S. Pat. No. 4,173,052, issued Nov. 6, 1979.

This invention relates to a riding power sweeper and more particularly to such a sweeper having a unique arrangement for emptying a hopper and adjusting a main brush.

A riding sweeper according to the invention employs a drum brush at an intermediate point under the machine with a driver's position being located at the rear of the sweeper. A hopper is located toward the front of the machine with a rear opening communicating with the drum brush to receive dirt and debris therefrom. The hopper has a pair of forwardly extending arms pivotally connected to a front portion of the sweeper body and fluid-operated rams are connected to the arms. When the rams are extended, the hopper is raised and pivotally moved over the front of the machine with the dirt and debris from the hopper then emptied into a suitable receptacle in front of the machine.

The hopper also includes a unique air distribution system. Accordingly, an exhaust blower is mounted above the drum brush and communicates with an upper portion of the hopper and specifically with a filter chamber therein. Air is then drawn around the drum brush through the hopper and through the separate chamber. A filter is located in the chamber and is interposed between the hopper and the exhaust blower. The chamber-forming means is pivotally supported by the hopper and swings outwardly when the hopper is dumped, emptying dirt from the filter at the same time. A pivotal lid also seals off the top of the hopper and the chamber.

The power sweeper also features a unique drum brush mechanism. This includes a single linkage arrangement extending upwardly from the brush and connected to two handles, one of which is adjustable to raise and lower the brush and change the pressure of the brush on the floor while the other is effective to adjust the brush relative to the floor to wear.

It is, therefore, a principal object of the invention to provide a riding power sweeper having the features and advantages outlined above.

Many other objects and advantages of the invention will be apparent from the following detailed description of a preferred embodiment thereof, reference being made to the accompanying drawings, in which.

Figure 1:
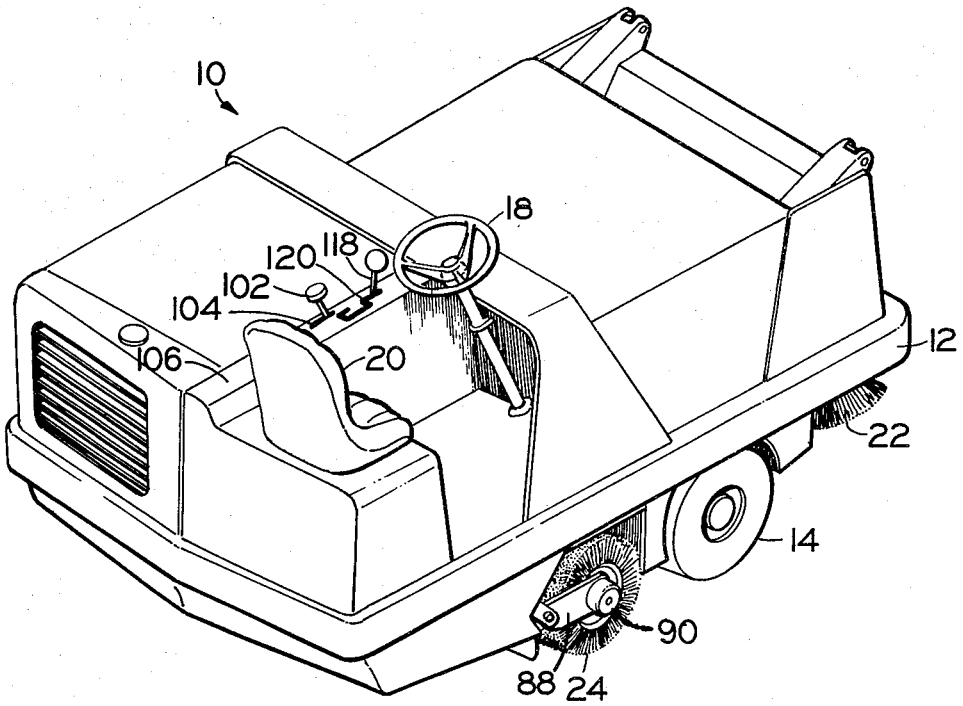
FIG. 1 is a rear view in perspective of a riding sweeper embodying the invention.
Figure 2:
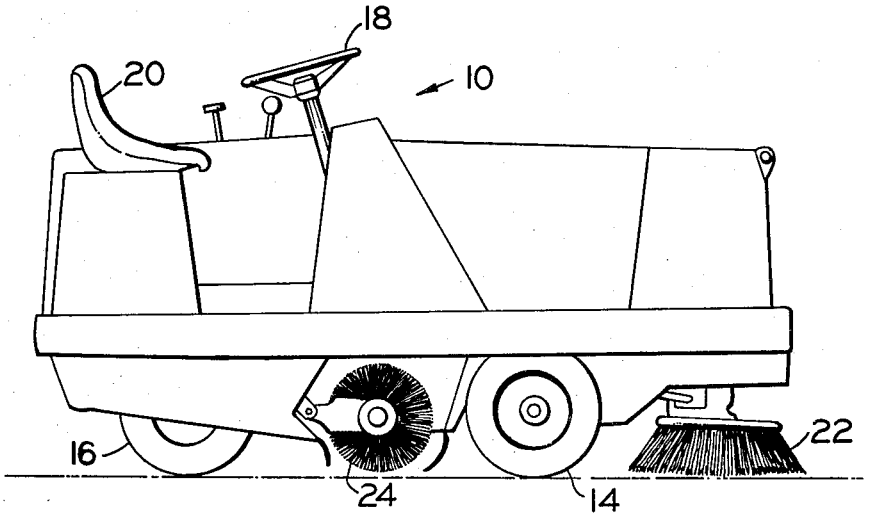
FIG. 2 is a side view in elevation of the sweeper of FIG. 1.

Referring to the drawings, and more particularly to FIGS. 1 and 2, a riding power sweeping machine embodying the invention is indicated at 10. The machine includes a main frame or body 12 with intermediate wheels 14 and a central, rear wheel 16 which is steered by a steering wheel 18 located in front of a rear operator's seat 20. One or two side brooms 22 can be located in front of the wheels 14, as is known in the art, and a main drum brush 24 is located to the rear of these wheels.

Figure 4:
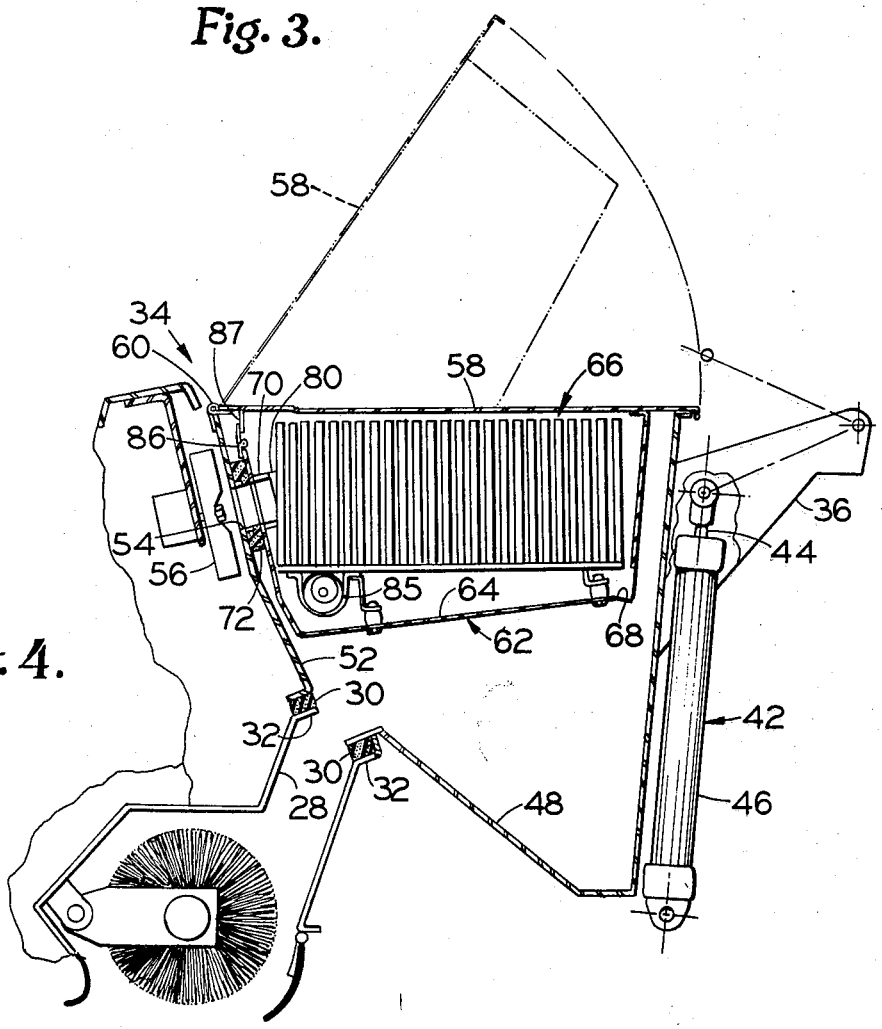
FIG. 4 is a view in vertical cross section taken through the hopper and associated components of the sweeper.

Referring more particularly to FIG. 4, the drum brush 24 is located in a chamber 26 extending across the machine 10, which chamber communicates with a forwardly and upwardly-extending discharge passage 28. This passage has a gasket 30 at the upper end thereof located on discharge opening flanges 32.

A hopper indicated at 34 is located in front of the discharge passage 28 and includes a pair of forwardly-extending arms 36 located at an upper forward portion thereof. These are pivotally connected by pins 38 to a forward, upwardly-extending support 40. A pair of fluid-operated rams 42 have piston rods 44 pivotally connected to the arms 36 between the hopper and the pivot pins 38, with cylinders 46 of the rams pivotally connected to a portion of the main frame 12. The hopper 34 also includes a slanted bottom wall 48 having an elongate opening 50 around which the gasket 30 is in contact when the hopper is in the lower, operating position. A slanted upper rear wall 52 of the hopper has an opening 54 which communicates with a centrifugal exhaust blower 56 mounted on the machine behind the hopper 34. A lid 58 is pivotally connected to the upper edge of the rear wall 52 by a hinge 60 and rests on the upper edge of the hopper 34 when in the operating position with a suitable seal or gasket (not shown) located therebetween.

A housing 62 forms a separate filter chamber 64 within the hopper 34, with a filter 66 located in the chamber. The housing 62 has an inlet opening 68 at a forward lower portion thereof and an exhaust opening at a rear portion thereof from which an exhaust nipple 70 extends. The exhaust opening communicates with the opening 54 adjacent the exhaust blower 56 with a gasket 72 located therebetween. The air drawn through the hopper 34 and the inlet opening 68 passes through the filter 66 before being exhausted through the exhaust nipple 70 to the blower 56.

Figure 5:
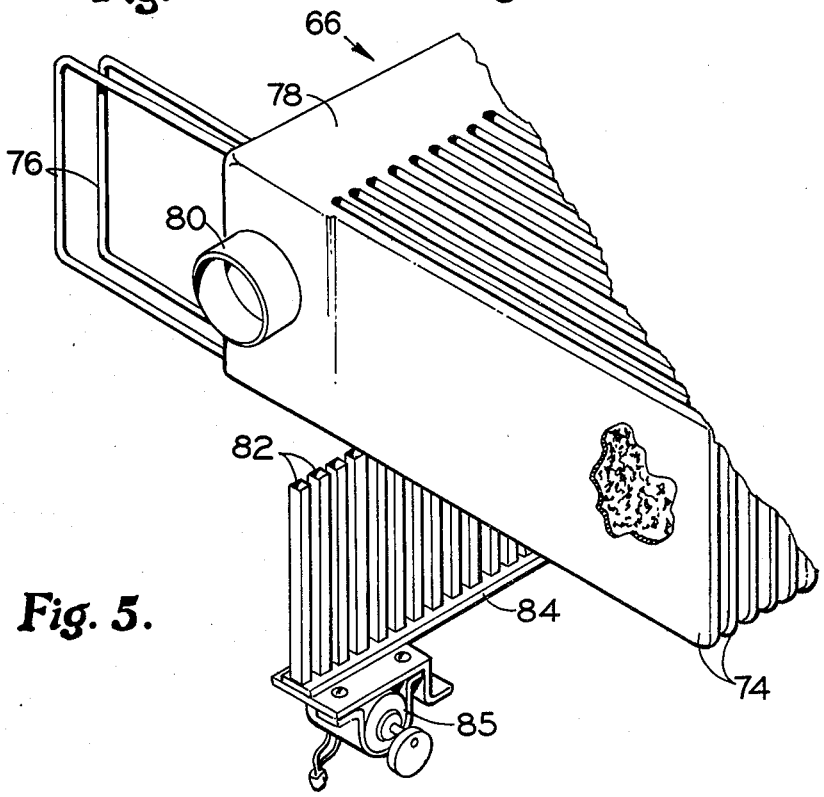
FIG. 5 is a view in perspective of a portion of the air filtering system of the sweeper.

As shown in FIG. 5, the filter 66 includes a plurality of spaced pockets 74 of filter cloth material held in spaced relationship by wire frame members 76. At one end, the pockets 74 communicate with a manifold 78 which is connected to a sleeve 80 mounted over the exhaust nipple 70.

For cleaning the filter 66 and specifically the pockets 74, a plurality of rigid fingers 82 are mounted on a plate 84 and extend upwardly between the pockets. When the fingers 82 are vibrated by a vibratory motor 85 mounted under the plate 84, the fingers shake the pockets 74, and cause the dirt to fall downwardly, being collected in the bottom of the housing 62.

Figure 3:
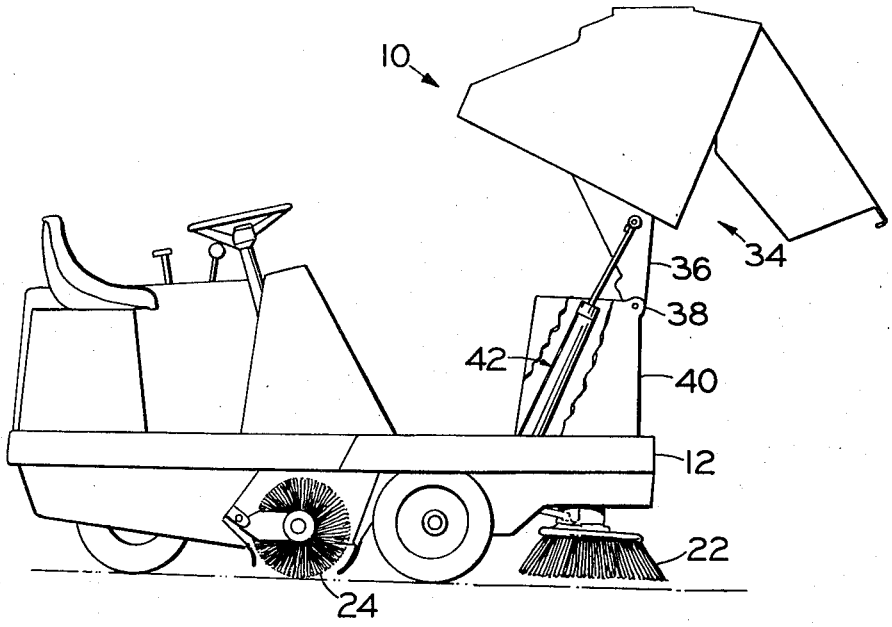
FIG. 3 is a fragmentary side view of the sweeper of FIG. 1 with a hopper thereof in a raised, dumping position.

The rear of the housing 62 is pivotally carried by the hopper 34 and specifically is pivotally connected by a hinge 86 (FIG. 4) to a flange 87 which extends downwardly from the lid 58 near the lid hinge 60. When the hopper 34 is extended to the dumping position, as shown in FIG. 3, the housing 62 also swings outwardly along with the lid 58, causing dust and dirt collected in the bottom of the housing 62 to be emptied through the inlet opening 68. At the same time, the housing 62 swings clear of the hopper 34 so that dirt therein can be dumped by sliding along the forward wall thereof.

Referring now to FIGS. 1 and 6–8, the main broom 24 is rotatably carried on end bars 88, one of which has a hydraulic motor 90 which rotates the brush in a counterclockwise direction. The end bars are affixed to a cross connecting shaft 92, at an intermediate portion of which is affixed a generally C-shaped link 94. The C-shaped link 94 is thereby rigidly connected to the end bars 88 so that pivotal movement of the link causes corresponding movement of the end bars. A positioning rod 96 with an upper threaded end 98 is pivotally connected to the upper end of the C-shaped link 94. A threaded adjusting sleeve 100 is threadably engaged with the end 98 of the rod 96 and has an adjusting knob 102 at the upper end. The sleeve 100 extends through a slot 104 (FIG. 1) in a panel 106 adjacent the operator's seat 20 so that the knob can be turned by the operator to adjust the brush 24 for wear, as will be discussed more fully subsequently.

The positioning rod 96 slidably extends through a bore in a cylindrical member 108 which is pivotally supported in two yoke arms 110. These, in turn, are affixed to a shaft 112 which is rotatably carried by ears 114 mounted on a transverse frame member 116 of the machine. A lever 118 is affixed to the shaft 112, causing the shaft 112 and the yoke arms 110 to pivot as the lever is pivotally moved. The lever 118 extends through a slot 120 in the panel 106 and is manipulated by the operator.

Figure 6:
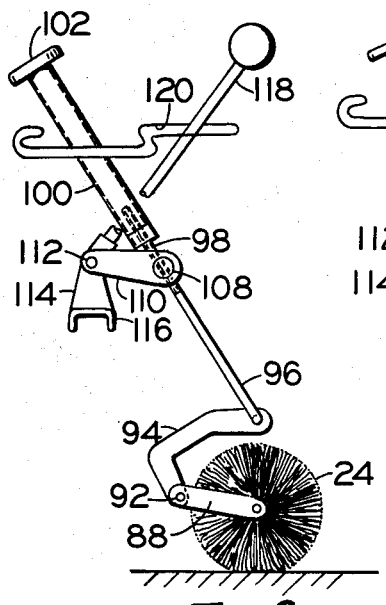
FIG. 6 is a schematic side view in elevation of mechanism for positioning and adjusting the drum brush of the sweeper.
Figure 7:
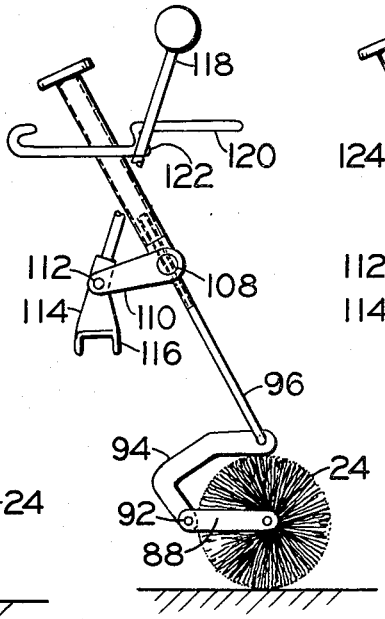
FIG. 7 is a view similar to FIG. 6 with certain components in different positions.
Figure 8:
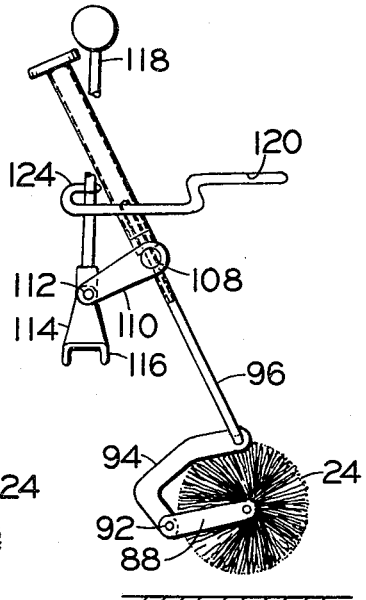
FIG. 8 is a view similar to FIG. 6 with certain components in still different positions.

In the position of FIG. 6, the lever 118 is located near the forward end of the slot 120 and the entire weight of the brush 24 is on the surface being cleaned, with the brush allowed to float on the surface.

When the lever 118 is moved rearwardly to a first notch 122 in the slot 120 (FIG. 7) the yoke arms 110 are moved counterclockwise, with the cylindrical member 108 moved upwardly against the end of the sleeve 100, raising the positioning rod 96 somewhat to support some of the weight of the drum brush 24, thereby decreasing the pressure of the brush on the surface being cleaned, but still enabling contact therebetween.

When the lever 118 is moved to a rear notch 124 in the slot 120 the yoke arms 110 are raised further to raise the rod 96 sufficiently to lift the drum brush 24 off of the surface through the link 94 and the end bars 88. In this position, the machine can be transported from one cleaning site to another with the brush out of contact with the surface.

The adjusting sleeve 100 is employed to adjust the drum brush 24 for wear. As the brush wears, the sleeve 100 is turned by the knob 102 to move higher relative to the threaded end 98 of the rod 96 so that the brush axis will then be in a lower position to maintain the same relative contact with the surface even though the bristles are shorter due to wear. In the transporting position of FIG. 8, the brush 24 will still be off the surface even though the sleeve 100 is raised, since the bristles will be shorter. It will thus be seen that through the one common linkage arrangement including the positioning rod 96, the C-shaped link 94, and the end arms 88, the brush can both be positioned in several positions by the operator and adjusted for wear.

Various modifications of the above-described embodiment of the invention will be apparent to those skilled in the art, and it is to be understood that such modifications can be made without departing from the scope of the invention, if they are within the spirit and the tenor of the accompanying claims.

We claim:

1. A sweeping machine comprising a body, a drum brush rotatably carried by said body in a transverse position, a hopper located at a forward position above said drum brush and having forwardly-extending arms at an upper front portion thereof, means pivotally connecting said arms to a front portion of said body, said hopper having an open top, a lid pivotally connected to said hopper at a rear edge of said top, fluid-operated rams having ends connected to said arms at portions spaced from the pivotal connections thereof and having other ends connected to said body, said fluid-operated rams being positioned to pivot said hopper forwardly over the front of said sweeping machine when said rams are extended, said lid also swinging open when said hopper top is moved beyond a vertical position to a dumping position by said rams, a blower carried by said machine to the rear of said hopper, and wall means forming a filter chamber in an upper portion of said hopper, said wall means having an opening communicating with said blower through the hopper.

2. A sweeping machine according to claim 1 characterized by said wall means further having another opening communicating with the interior of said hopper, and a filter in said filter chamber interposed between said openings of said wall means.

3. A sweeping machine comprising a body, a drum brush rotatably carried by said body in a transverse position, a hopper having an open top, said hopper being located at a front portion of said body, said hopper having a forward upper portion pivotally connected to said body, at least one fluid-operated ram having one end pivotally connected to said hopper and another end connected to said body, said fluid-operated ram being positioned to pivot said hopper forwardly over the front of said body when said ram is extended, wall means forming a filter chamber located in said hopper, said wall means forming an outlet opening for communication with an exhaust blower and an inlet opening at a forward portion thereof near the bottom of said filter chamber for communication with the interior of said hopper, said wall means being pivotally carried by said hopper in a position such that said wall means swings to an open position with the forward portion of said wall means spaced from the open top of said hopper when said hopper top is moved beyond a vertical position when said hopper is pivoted by said fluid-operated ram, with dirt collected in said wall means emptying through the inlet opening beyond said hopper.

4. A sweeping machine according to claim 3 characterized by a filter in said filter chamber interposed between said inlet opening and said outlet opening, and means for shaking said filter to cause dirt collected thereby to fall to the bottom of said filter chamber and be collected by said wall means.

5. A sweeping machine according to claim 4 characterized by said filter comprising filter cloth forming a plurality of pockets into which air passes from the outside, and said shaker means being carried by said wall means and engagable with said pockets to shake dirt therefrom.

6. A sweeping machine according to claim 1 being characterized by said wall means being pivotally carried by said hopper and swinging open with at least a portion thereof spaced from the open top of said hopper when said hopper is moved to the dumping position by said rams, to empty dirt from said filter chamber beyond said hopper.

7. A sweeping machine according to claim 6 characterized by said wall means being pivotally carried by said hopper through a lid which is pivotally attached to an upper portion of said hopper with said wall means, in turn, being pivotally connected to said lid.

* * * * *